US007455206B2

(12) United States Patent
Huang

(10) Patent No.: US 7,455,206 B2
(45) Date of Patent: Nov. 25, 2008

(54) ELECTRIC STAPLER STRUCTURE

(76) Inventor: Chien-Chuan Huang, No. 162-1, Shanjiao Rd., Dacun Township Changhua County 515 (TW)

( * ) Notice: Subject to any disclaimer, the term of this patent is extended or adjusted under 35 U.S.C. 154(b) by 0 days.

(21) Appl. No.: 11/600,926

(22) Filed: Nov. 17, 2006

(65) Prior Publication Data

US 2008/0116243 A1 May 22, 2008

(51) Int. Cl.
*B25C 5/02* (2006.01)
*B27F 7/36* (2006.01)

(52) U.S. Cl. ..... 227/120; 227/139; 227/156

(58) Field of Classification Search ..... 227/133, 227/134, 131, 135, 139, 124, 127, 7, 120, 227/156

See application file for complete search history.

(56) References Cited

U.S. PATENT DOCUMENTS 2,433,155 A * 12/1947 Peterson ..... 227/127
2,801,414 A * 8/1957 Mueller ..... 227/127
2,819,466 A * 1/1958 Campbell et al. ..... 227/127
2,957,174 A * 10/1960 Oussani ..... 227/131
3,215,324 A * 11/1965 Dorney ..... 227/123
3,437,250 A * 4/1969 Fiedler ..... 227/127
3,625,408 A * 12/1971 Amakawa et al. ..... 227/131
3,734,379 A * 5/1973 Powers ..... 227/127
4,574,993 A * 3/1986 Yamanoi ..... 227/131
4,940,177 A * 7/1990 Jimena ..... 227/7
5,005,753 A * 4/1991 Gravina ..... 227/120
5,657,918 A * 8/1997 Shimomura et al. ..... 227/7
6,062,457 A * 5/2000 Huang ..... 227/134
6,135,337 A * 10/2000 Harris et al. ..... 227/131
6,811,070 B2 * 11/2004 Takada ..... 227/120
6,820,790 B2 * 11/2004 Ura ..... 227/131
7,044,351 B2 * 5/2006 Ronconi ..... 227/123
2005/0199675 A1 * 9/2005 Takada ..... 227/134
2006/0266787 A1 * 11/2006 Ura ..... 227/131
2006/0273134 A1 * 12/2006 Smith et al. ..... 227/131

FOREIGN PATENT DOCUMENTS

EP 242021 A1 * 10/1987

* cited by examiner

*Primary Examiner*—Paul R Durand
(74) *Attorney, Agent, or Firm*—Troxell Law Office, PLLC

(57) ABSTRACT

The present invention provides an improved electric stapler structure, structured to include a housing and a staple slot fixing piece. A driving arm is located at one side within a mount corresponding to staple pushing pieces of the staple slot fixing piece. The staple pushing pieces are used to cause a spring piece of a pressure piece to squeeze a staple. Furthermore, a central bearing base is located at another side of the mount, so that when a stop piece of a hook ring separates from an inverted hook portion of the central bearing base, then a groove and buffering of a stop portion is used to block a protruding piece of a blocking piece, thereby preventing the central bearing base from flicking out in a split second due to the elastic force of a pull piece spring, and thus safeguarding safety of the user during use.

5 Claims, 10 Drawing Sheets

ELECTRIC STAPLER STRUCTURE

BACKGROUND OF THE INVENTION (a) Field of the Invention

The present invention provides an improved electric stapler structure, wherein when a stop piece of a hook ring separates from an inverted hook portion of a central bearing base, then the central bearing base flicks open due to the elastic force of a pull spring, at which time the central bearing base then uses a protruding piece of a blocking piece in a groove of a central bearing jacket to function as a buffer and block.

(b) Description of the Prior Art

Referring to FIG. 1 and FIG. 2, which show a conventional electric stapler A, wherein when a hook ring A1 is pressed causing a stop piece A2 to separate from an inverted hook portion A4 of a central bearing base A3, then a pull spring A5 flicks open the central bearing base A3. However, because of a momentary excessive elastic force of a pull spring A5 that causes the central bearing base A3 to flick out in a split second, thus, injury to a user or striking of peripheral objects easily results.

Hence, the inventor of the present invention proposes to provide an improved electric stapler structure to resolve and surmount existent technical difficulties to eliminate the aforementioned shortcomings of prior art.

SUMMARY OF THE INVENTION

The present invention provides an improved electric stapler structure, wherein when a stop piece of a hook ring separates from an inverted hook portion of a central bearing base, then the central bearing base flicks open due to the elastic force of a pull spring, at which time the central bearing base uses a protruding piece of a blocking piece in a groove of a central bearing jacket to function as a buffer and block, thereby preventing the central bearing base from flicking out in a split second due to the elastic force of the pulling spring and injuring a user.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
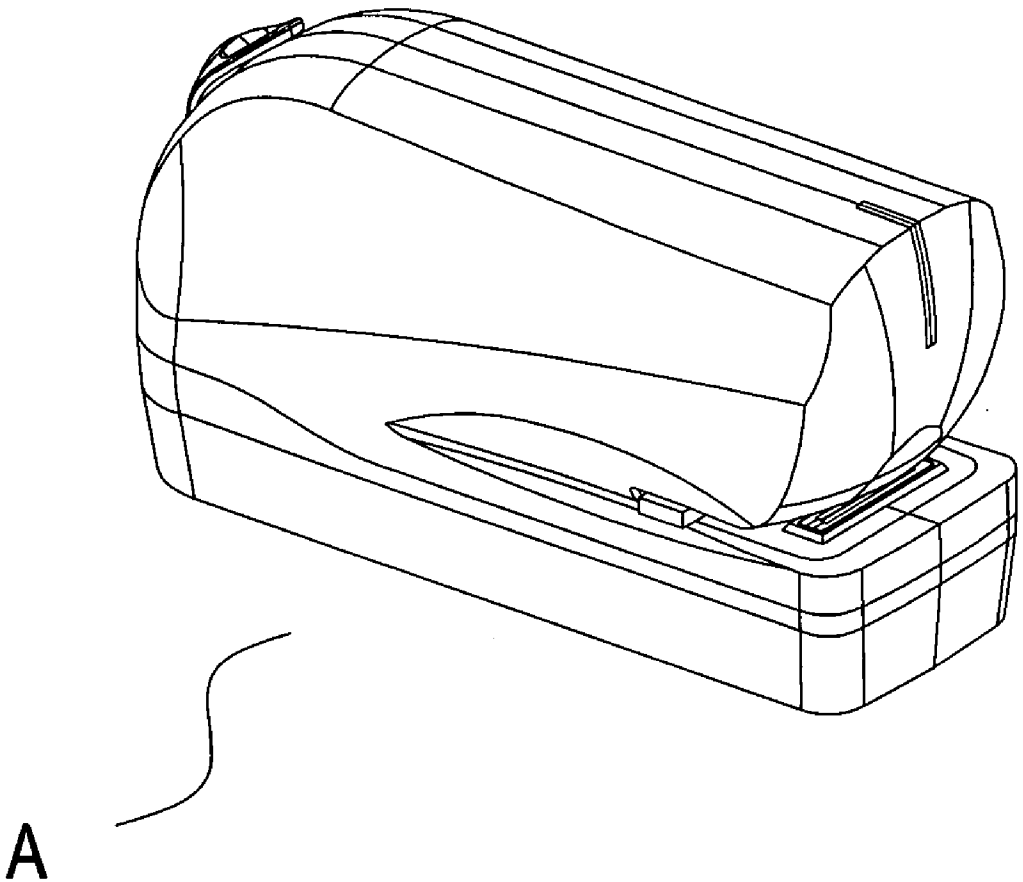
FIG. 1 Prior Art
FIG. 1 shows an elevational view of prior art.
Figure 2:
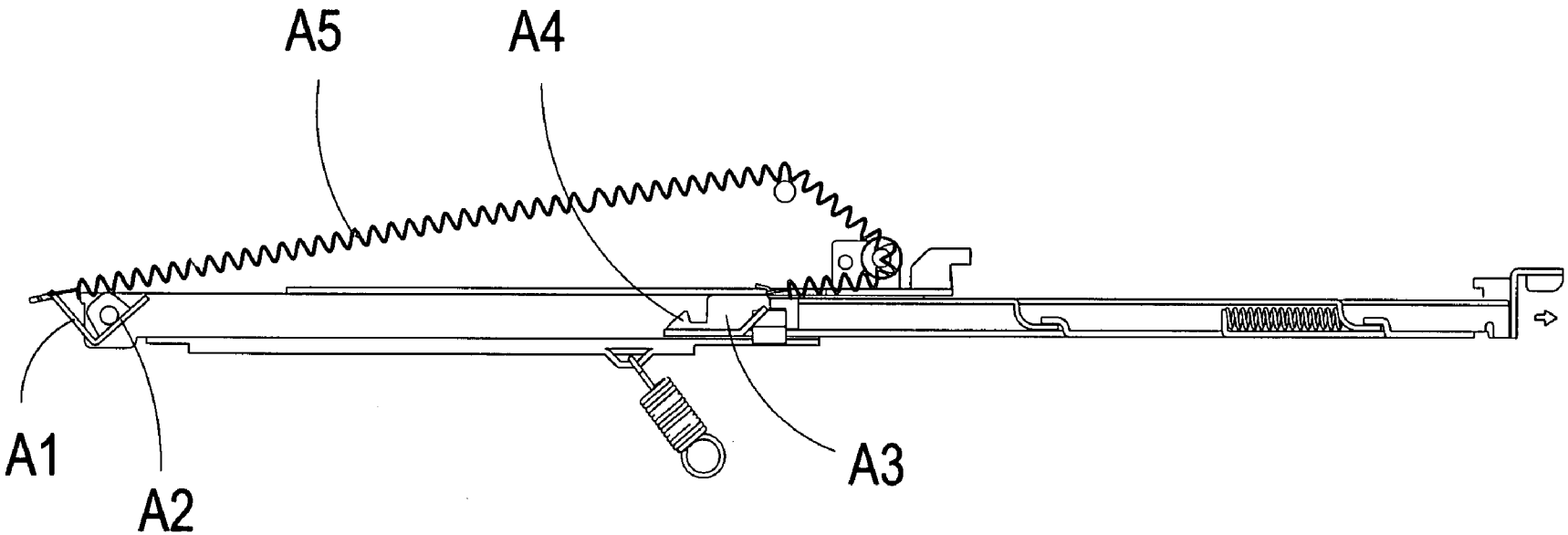
FIG. 2 Prior Art
FIG. 2 shows an exploded view of prior art.
Figure 3:
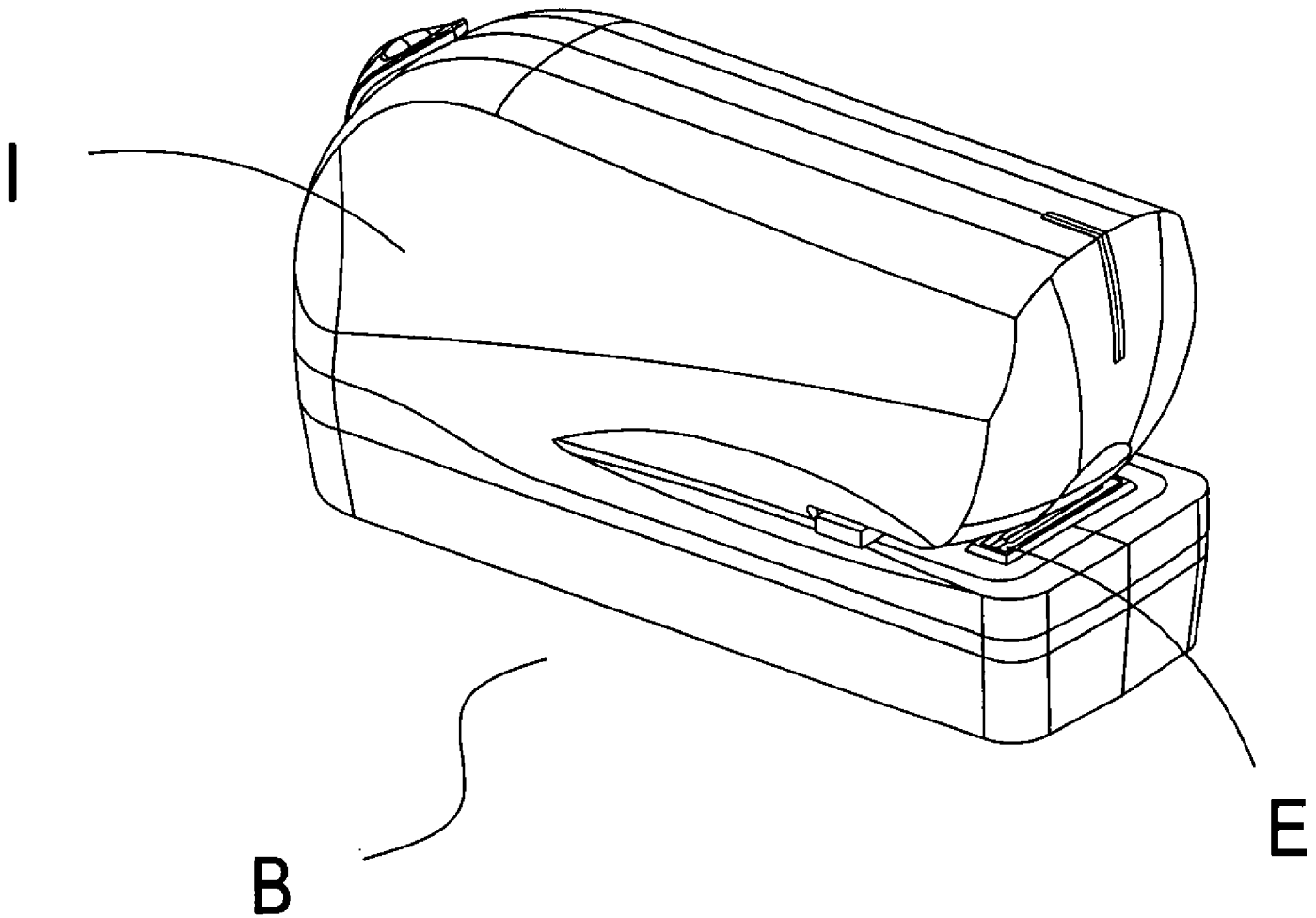
FIG. 3 shows an elevational view according to the present invention.
Figure 4:
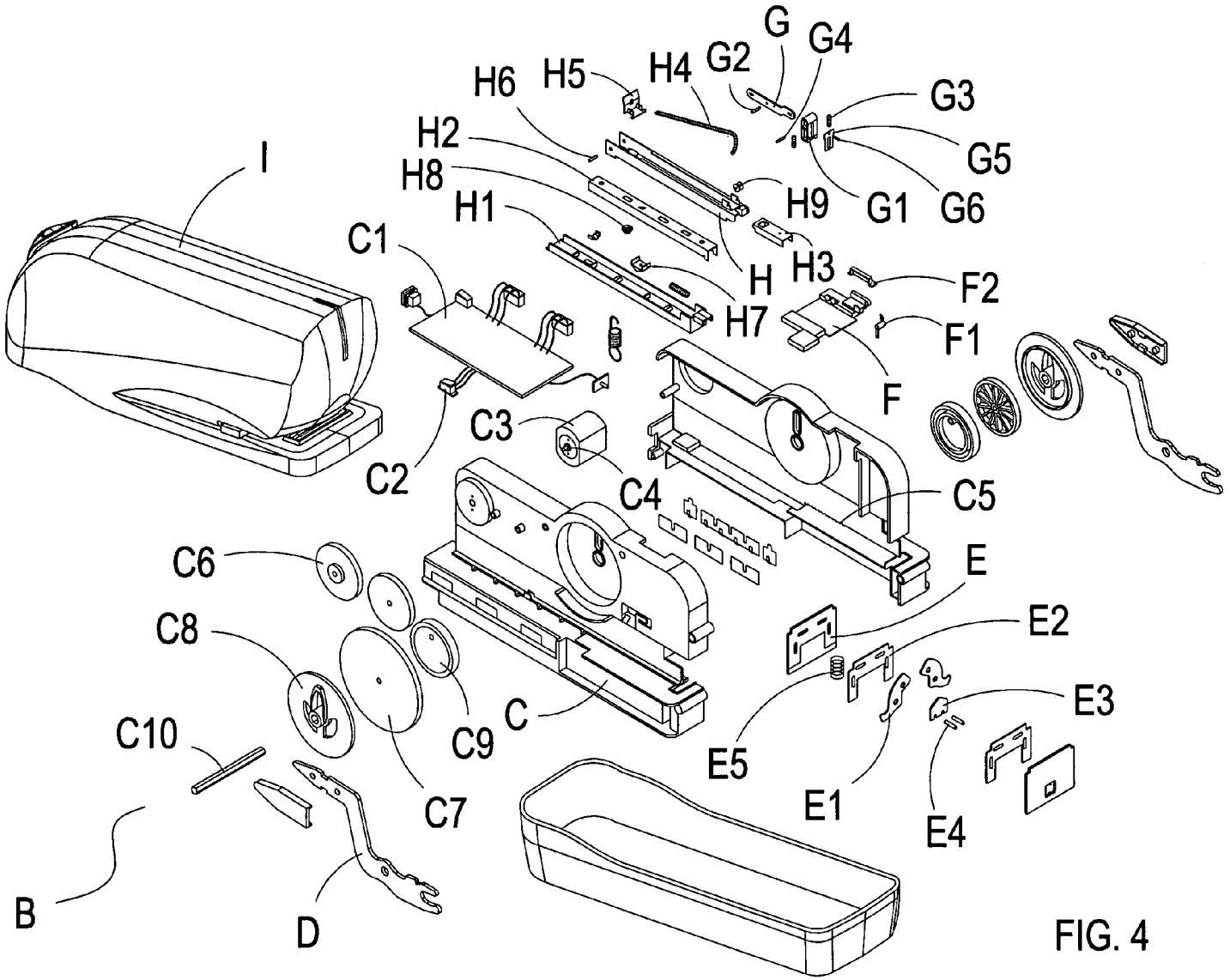
FIG. 4 shows an exploded view according to the present invention.
Figure 5:
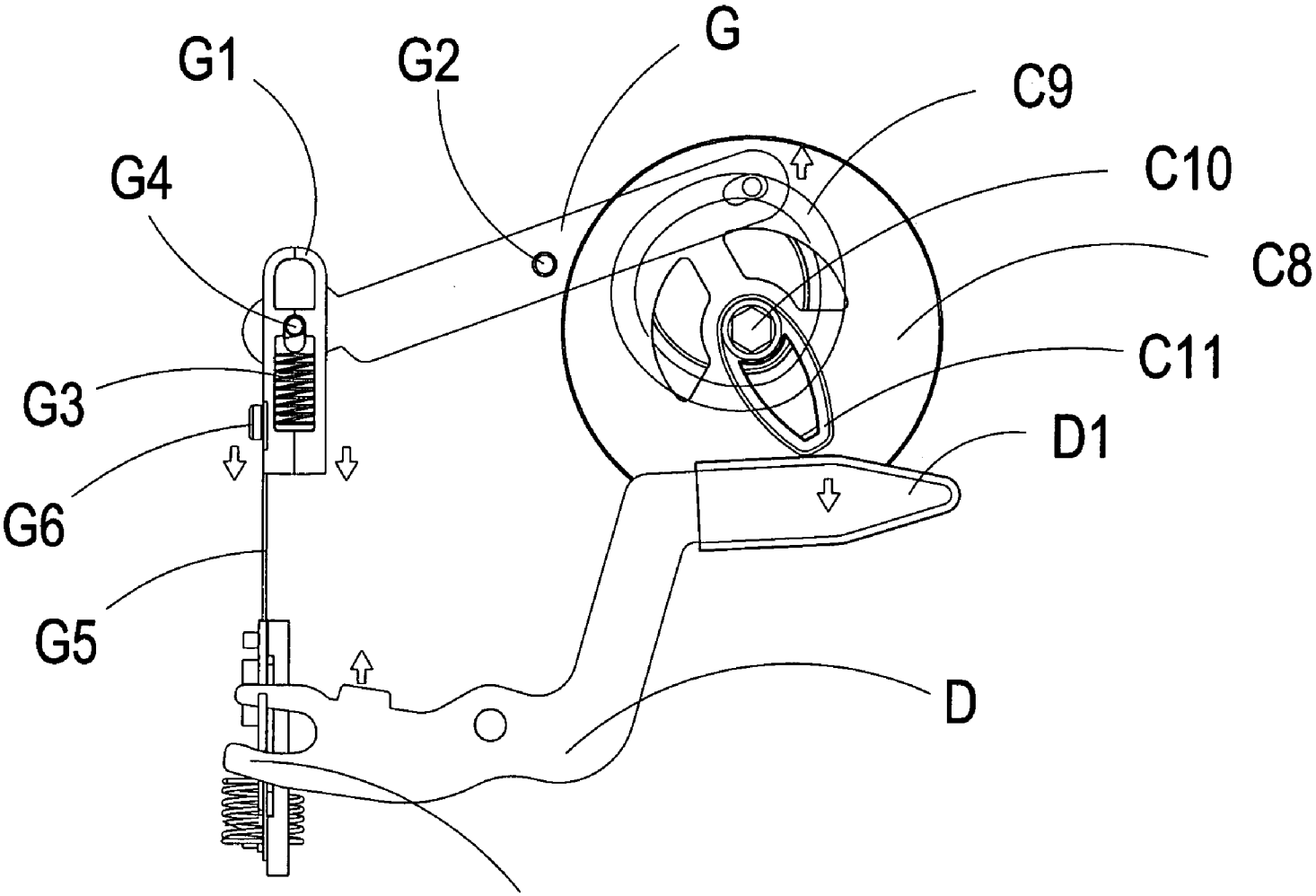
FIG. 5 shows a first view of an embodiment according to the present invention.
Figure 6:
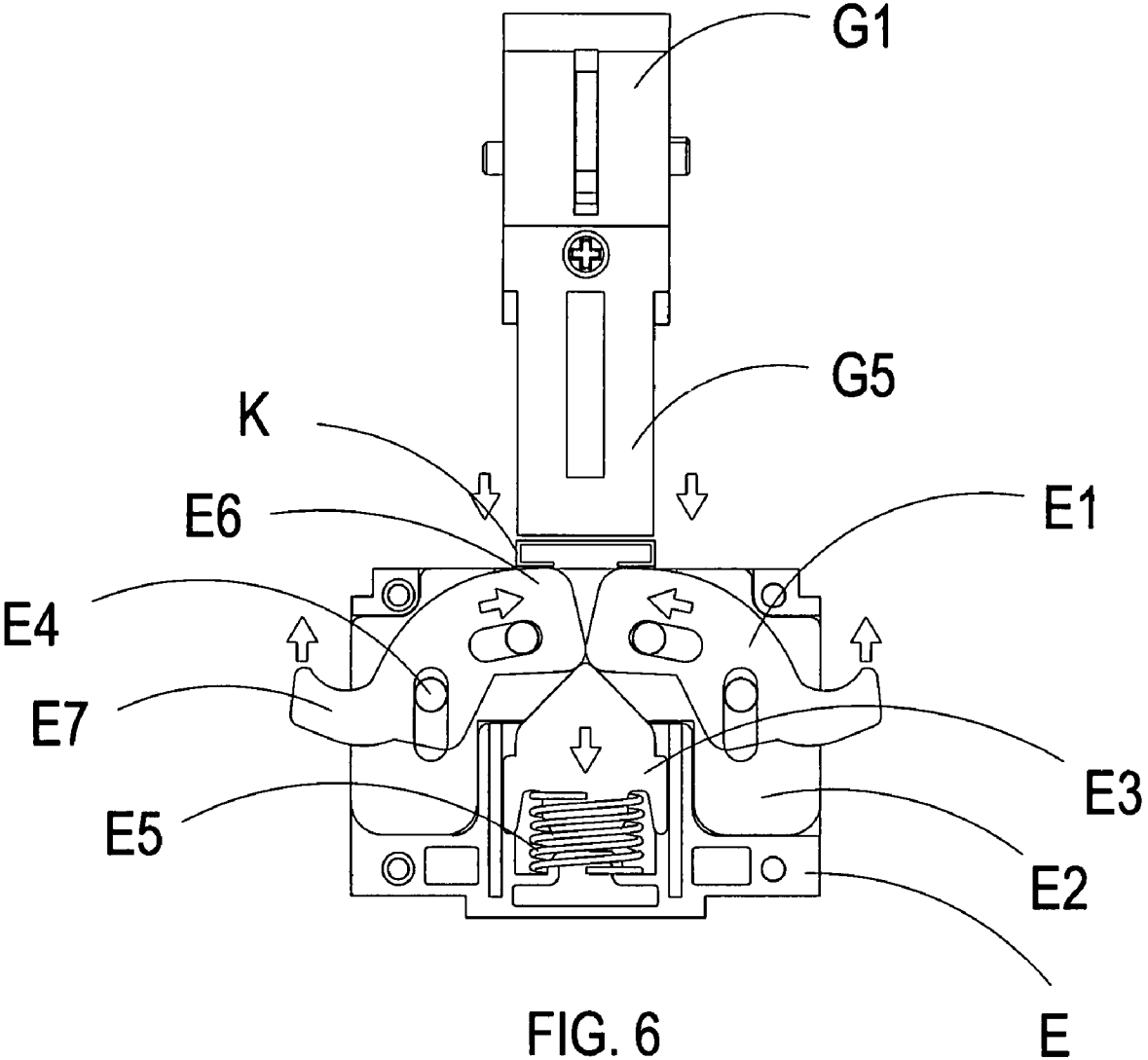
FIG. 6 shows a second view of the embodiment according to the present invention.
Figure 7:
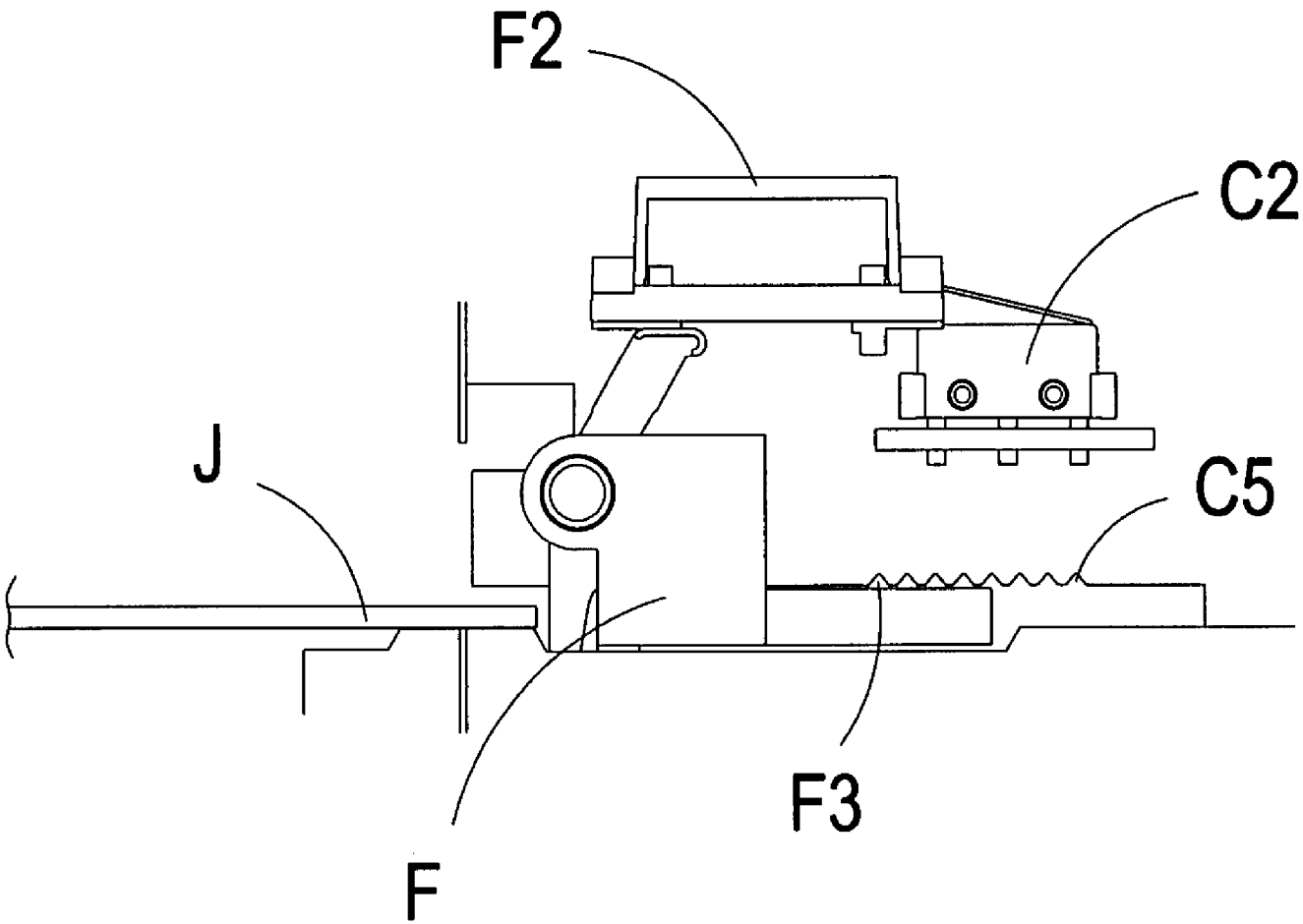
FIG. 7 shows a third view of the embodiment according to the present invention.
Figure 8:
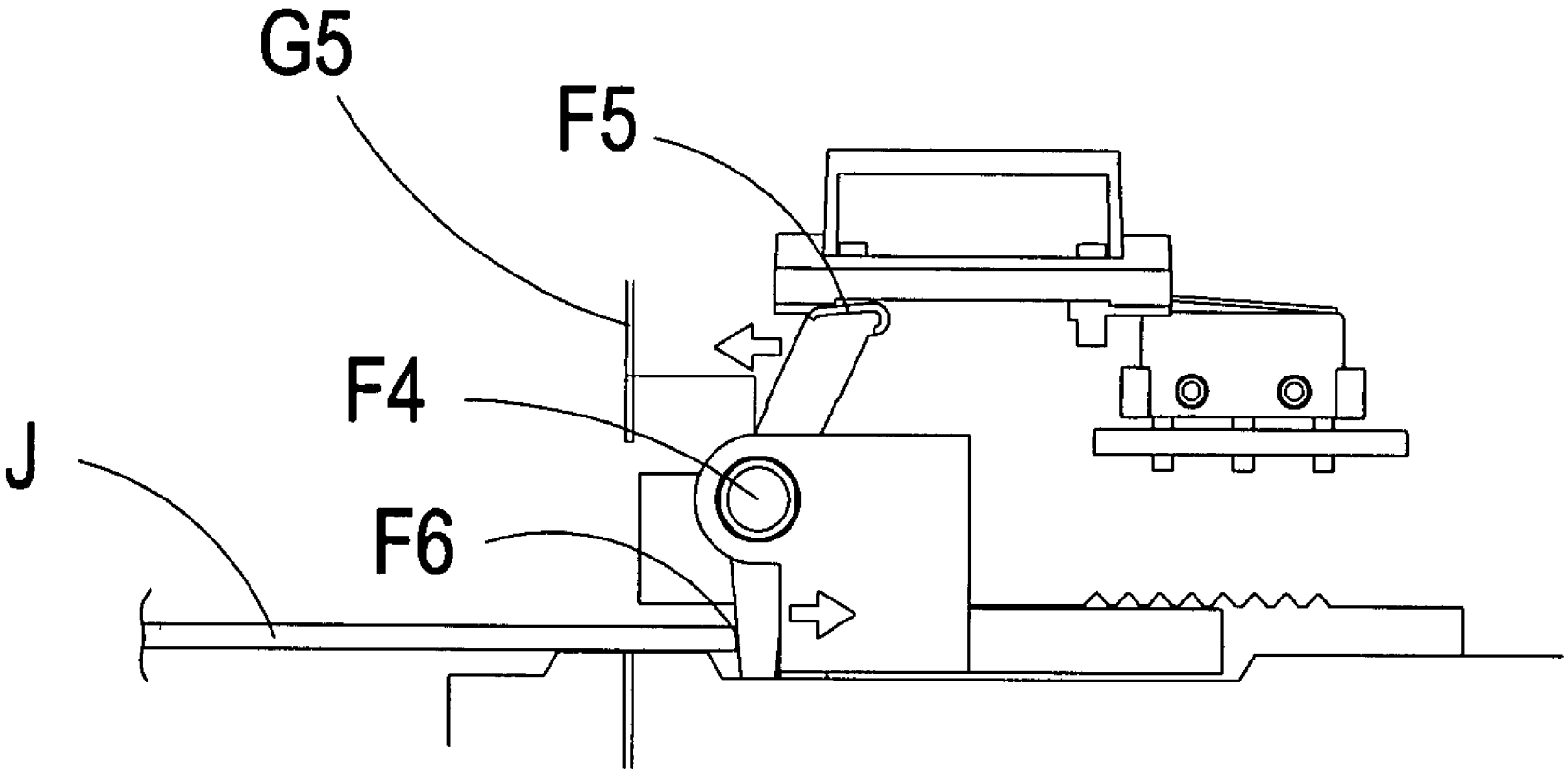
FIG. 8 shows a fourth view of the embodiment according to the present invention.
Figure 9:
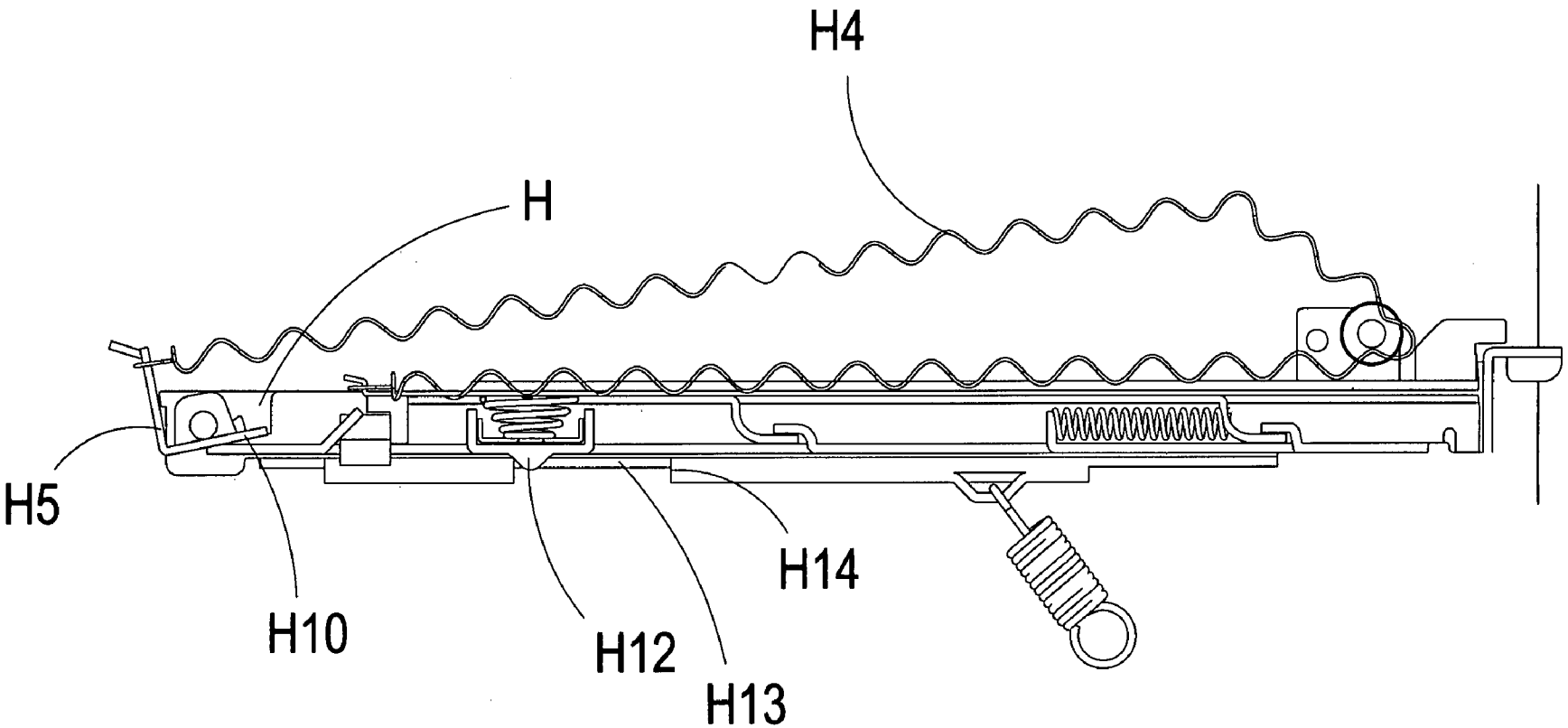
FIG. 9 shows a fifth view of the embodiment according to the present invention.
Figure 10:
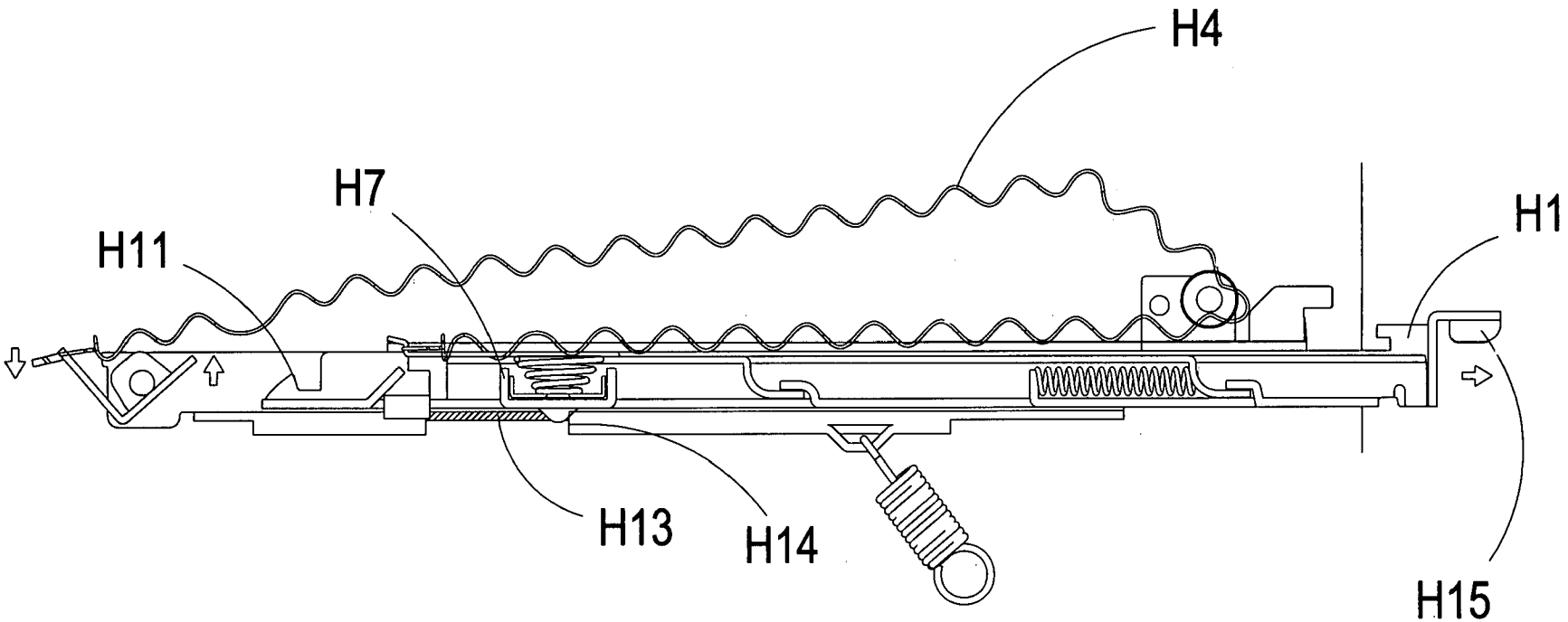
FIG. 10 shows a sixth view of the embodiment according to the present invention.

Referring to FIG. 3 and FIG. 4, which show an electric stapler B of an improved electric stapler structure of the present invention, comprising a housing I and a staple slot fixing piece E, moreover, a mount C is installed interior of the housing I of the electric stapler B, and a circuit board Cl and a motor C3 are configured within the mount C. A drive shaft C4 penetrates the motor C3 to the exterior of the mount C to accommodate a gear C6 which actuates a drive gear C7. A drive piece C8 is located at one side of the drive gear C7, and an eccentric wheel C9 is located at another side of the drive gear C7. A hexagonal spindle C10 fixes the drive gear C7, and the drive piece C8 and the eccentric wheel C9 respectively located on two sides thereof.

The drive piece C8 actuates a driving arm D relatively clasped to staple pushing pieces E1. Moreover, a plurality of staple slot insertion pins E4 penetrate the staple pushing pieces E1 and a staple slot positioner E2. Furthermore, a positioning piece E3 abuts against lower sides of the staple pushing pieces E1. A staple slot spring E5 is installed at another side of the positioning piece E, and another side of the staple slot spring E5 is fixed to the staple slot fixing piece E. Moreover, the staple slot positioner E2, the staple pushing pieces E1, the positioning piece E3 and the staple slot spring E5 are clasped within the staple slot fixing piece E by means of relatively located piece members. A pressure bar G is correspondingly located at a side of the eccentric wheel C9, and a pressure bar pin G2 fixedly fastens the pressure bar G. Moreover, the pressure bar G extends to a corresponding pressure piece G1 lateral thereof. The pressure bar G and the pressure piece G1 are mutually fixed using a pressure piece pin G4. Pressure piece springs G3 are respectively located two sides of the pressure piece G1. One side of the pressure piece springs G3 abuts onto the pressure piece pin G4, and another side abuts onto the pressure piece G1. Furthermore, a spring piece G5 is located on a side of the pressure piece G1. Screws G6 are used to fixedly screw the spring piece G5 to the pressure piece G1.

Furthermore, a slide base F is located on the mount C and clasped to a serrated slide track C5. A touch member F1 is located on the slide base F, and a side of the touch member F1 abuts against an activating member F2, and further abuts against a touch switch C2 of the circuit board C. Moreover, a central bearing jacket H is located within the mount C. A hook ring H5 is located at a side of the central bearing jacket H, and the hook ring H5 is fixed by means of a pin H6 inserted into the central bearing jacket H. Moreover, a guide wheel H9 is located at another side of the central bearing jacket H, and a central bearing base H1 is installed interior of the central bearing jacket H. A blocking piece H7 is located interior of the central bearing base H, and a spring H8 is located on an upper side of the blocking piece H7. An inner auxiliary H2 and a mutually clasped pull piece H3 are located on the central bearing jacket H. One end of a pull piece spring H4 is fastened to the pull piece H3, and another end of the pull piece spring H4 extends and penetrates the guide wheel H9 and is mounted onto the hook ring H5.

Referring to FIG. 4, FIG. 5, FIG. 6, FIG. 7, FIG. 8, FIG. 9 and FIG. 10, which show an embodiment of the improved electric stapler structure of the present invention, wherein the circuit board Cl and the motor C3 are configured within the mount C. When a user causes articles J he wishes to bind with staples to abut against the touch member F1 of the slide base F, then the touch member F1 immediately abuts against the activating member F2, thereby pressing the activating member F2 up against the touch switch C2 on the circuit board Cl, whereupon the touch switch C2 actuates rotation of the motor C3 and causes the drive shaft C4 of the motor C3 to drive the gear C6. Rotation of the gear C6 actuates the drive gear C7, and because the drive gear C7 and the correspondingly located drive piece C8 are mutually fixed by the hexagonal spindle C10, thus, actuation of the drive gear C7 causes mutual driving of the drive piece C8, which pushes the correspondingly located driving arm D, thereby causing the driving arm D to actuate the staple pushing pieces E1 of the staple slot fixing piece E, whereupon the pressure bar G downwardly presses the pressure piece G1 via rotation of the eccentric wheel C9 and causes the spring piece G5 of the pressure piece G1 to squeeze a staple K, which then pierces the articles J to be fastened together, whereupon a staple pushing portion E6 fixedly secures the staple K.

The drive gear C7 simultaneously drives the relatively located drive gear C8 and the eccentric wheel C9 when rotating. Moreover, the drive gear C8 actuates the driving arm D by means of an actuating protruding piece C11 nudging a driving arm jacket D1, whereupon a fixed hook portion D2 of the driving arm D upwardly pulls hook bar portions E7 of the staple pushing pieces E1, at which time movement of the staple slot positioner E2 and the staple slot insertion pins E4 tighten the staple pushing pieces E1 and downwardly presses the positioning piece E3. When the actuating protruding piece C11 rotates to another side, the positioning piece E3 uses the elastic force of the staple slot spring E5 to upwardly push the positioning piece E3. When the correspondingly located staple pushing pieces E1 separate, then the hook bar portions E7 of the staple pushing pieces E1 simultaneously move downward and downwardly actuate the driving arm D.

When the articles J to be fastened together are made to abut against a push bar F6 of the touch member F1, then movement of the touch member F1 and the slide base F actuated by an actuating bar F4 causes an abutting portion F5 to abut against the activating member F2, whereupon the drive member F2 simultaneously actuates the touch switch C2, which further actuates the motor C3. Furthermore, when the user wants to adjust binding depth of the articles J to be fastened together, a protruding body F3 of the slide base F can be adjusted on the serrated track C5 of the mount C.

When a user needs to replenish the staples K, a stop piece H10 of the hook ring H5 must be separated from an inverted hook portion H11 of the central bearing base H1, whereupon a groove and buffering of a stop portion H14 is used to block a protruding piece H12 of a blocking piece H7, thereby enabling a holding portion H15 to be used to withdraw the central bearing base, thereby preventing the central bearing base H1 from flicking out in a split second due to the elastic force of the pull piece spring H4, and thus safeguarding safety of the user during use and preventing striking of peripheral objects.

In order to better explicitly disclose advancement and practicability of the present invention, its advantages are described below:

1. When the pull piece H3 is subjected to the elastic force of the pull piece spring H4, the protruding piece H12 of the blocking piece H7 in the groove functions as a buffer and block.

2. An excessive elastic force does not cause the central bearing base H1 to flick open in a split second, injuring a user or striking peripheral objects.

3. Improves safety and practicability.

4. Provided with industrial competitiveness.

5. Provided with commercial utility value.

6. Provided with originality.

In conclusion, practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An electric stapler structure, comprising:

a housing and a staple slot fixing piece;

a mount is installed interior of the housing, and a circuit board and a motor are configured within the mount;

a central bearing jacket is located at one side within the mount, the central bearing jacket is clasped to a central bearing base, an inner auxiliary and a pull piece;

a pressure piece and a staple slot fixing piece are fitted to another side;

a protruding piece located on a blocking piece mounted to a spring underlying the protruding piece, the spring extending from the central bearing base, wherein the electric stapler structure being configured so that when a stop piece of a hook ring separates from an inverted hook portion of the central bearing base, the protruding portion temporarily blocks and buffers the movement of a stop portion in a groove of the central bearing base, thereby preventing the central bearing base from flicking out from the elastic force of a pull piece spring.

2. The electric stapler structure according to claim 1, wherein one end of the pull piece spring is mounted onto a mount end of the hook ring, and another end extends to a guide wheel and mounts onto a hook portion of the pull piece, wherein the electric stapler structure being configured so that when the protruding piece of the blocking piece is blocked by the stop portion in the groove, then a holding portion of a central bearing base draws out the central bearing base.

3. The electric stapler structure according to claim 1, wherein the electric stapler structure being configured so that when the motor actuates gears, a drive piece, an eccentric wheel and a driving arm are simultaneously actuated, and the driving arm upwardly pulls staple pushing pieces, and movement of a staple slot positioner and staple slot insertion pins closes the staple pushing pieces, and a positioning piece is pressed downward wherein the electric stapler structure being configured so that when an actuating protruding piece rotates to another side, then the elastic force of a staple slot spring upwardly pushes the positioning piece and separate the staple pushing pieces, which simultaneously cause hook bar portions of the staple pushing pieces to move downward to downwardly actuate the driving arm.

4. The electric stapler structure according to claim 3, wherein the electric stapler structure being configured so that when the positioning piece is pressed downward, the pressure bar downwardly presses the pressure piece via simultaneous rotation of the eccentric wheel, thereby enabling the elastic force of the pressure piece to squeeze a staple and pierce articles to be fastened together, and a staple pushing portion fixedly secures the staple.

5. The electric stapler structure according to claim 3, wherein the electric stapler structure being configured so that a motor actuates the gears by means of an activating member moving a touch switch, and movement of the activating member is caused by the articles to be fastened together abutting a push bar of a touch member, an actuating bar of the touch member causes an abutting portion thereof to abut the activating member, wherein the electric stapler structure being configured so that binding depth of the articles to be fastened together is adjusted by adjusting a protruding body of a slide base on a serrated slide track of the mount.

* * * * *